US007525524B2

(12) United States Patent
Tseng et al.

(10) Patent No.: US 7,525,524 B2
(45) **Date of Patent: *Apr. 28, 2009**

(54) DATA DRIVING CIRCUIT FOR ORGANIC LIGHT EMITTING DIODE DISPLAY

(75) Inventors: Jung-Chun Tseng, Neipu Township, Pingtung County (TW); Shin-Hung Yeh, Taipei (TW); Wein-Town Sun, Kaohsiung (TW)

(73) Assignee: Au Optronics Corp., Hsinchu (TW)

( * ) Notice: Subject to any disclaimer, the term of this patent is extended or adjusted under 35 U.S.C. 154(b) by 667 days.

This patent is subject to a terminal disclaimer.

(21) Appl. No.: 11/125,992

(22) Filed: May 10, 2005 (Under 37 CFR 1.47)

(65) Prior Publication Data

US 2005/0270206 A1 Dec. 8, 2005

(30) Foreign Application Priority Data

May 21, 2004 (TW) ..... 93114377 A

(51) Int. Cl.
*G09G 3/32* (2006.01)

(52) U.S. Cl. ..... 345/82; 315/169.3

(58) Field of Classification Search ..... 345/86, 345/204–215, 690–699, 76–83, 87–111; 341/144; 315/169.1–169.3
See application file for complete search history.

(56) References Cited

U.S. PATENT DOCUMENTS

| | | | | |
|---|---|---|---|---|
| 6,501,466 | B1 * | 12/2002 | Yamagishi et al. | 345/204 |
| 6,628,258 | B1 * | 9/2003 | Nakamura | 345/98 |
| 6,753,654 | B2 * | 6/2004 | Koyama | 315/169.1 |
| 6,999,048 | B2 * | 2/2006 | Sun et al. | 345/82 |
| 7,057,542 | B2 * | 6/2006 | Yeh et al. | 341/144 |
| 2002/0175890 | A1 * | 11/2002 | Dosho et al. | 345/100 |
| 2003/0132907 | A1 * | 7/2003 | Lee et al. | 345/98 |

* cited by examiner

*Primary Examiner*—Chanh Nguyen
*Assistant Examiner*—Long Pham
(74) *Attorney, Agent, or Firm*—Thomas, Kayden, Horstemeyer & Risley

(57) ABSTRACT

A data driving circuit and organic light emitting diode display, comprising a D/A converter, a switch unit, a first analog sampling storage circuit and a second analog sampling storage circuit. The first analog sampling storage circuit is controlled by a first signal for storing corresponding first analog transformed data in the first cycle, and controlled by a second signal for outputting first analog data corresponding to the first analog transformed data in the second cycle. The second analog sampling storage circuit is controlled by the second signal for storing the second analog transformed data in the second cycle, and controlled by the first signal for outputting second analog data corresponding to the second analog transformed data in a third cycle.

4 Claims, 7 Drawing Sheets

DATA DRIVING CIRCUIT FOR ORGANIC LIGHT EMITTING DIODE DISPLAY

BACKGROUND

The invention relates to a data driving circuit and an organic light emitting diode display, and more particularly, to a data driving circuit without digital latches.

Digital data drivers of a conventional active organic light emitting display use a storage register, digital latch as a line buffer to store digital video data in a signal line cycle.

FIGS. 1A and 1B show conventional 6-bit digital data driving scheme 10. In the scheme 10, binary bits of digital video data are loaded sequentially during a horizontal scan cycle. First, through data lines R[5]~B[0] binary bits of digital video data are written to corresponding first latches 11, all controlled by a sampling signal applied by a shift register SRn. Next, through data lines R[5]~B[0], binary bits of next digital video data are written to corresponding first latches 21, all controlled by a sampling signal applied by a shift register SRn+1. Then, all bits of digital video data set are stored in the first latches 11 and 21 are written to the second latches 12 and 22 when the line buffer signal "LB" is asserted and transmitted to the digital-to-analog converters DAC-Rn, DAC-Gn, DAC-Bn at the same time.

The bit number of data increases as resolution goes higher, thus increasing the number of storage registers which occupy layout areas and increasing the number of digital-to-analog converters. In the conventional driving circuit layout, the bit number of data increases as resolution goes higher, and the number of storage registers and digital-to-analog converters are increased accordingly, making the layout more difficult, as the horizontal layout area of the digital data driving circuits is limited.

SUMMARY

It is an object of the present invention to provide a data driving circuit which comprises data lines transmitting first digital data in a first cycle and second digital data in a second cycle; a D/A converter (digital-to-analog converter) receiving the first digital data for transforming to corresponding first analog transformed data and receiving the second digital data for conversion to corresponding second analog transformed data; a switch unit coupled to the D/A converter and turned on by a sampling signal in the first cycle and the second cycle; a first analog sampling storage circuit coupled to the switch unit, controlled by a first signal for storing the first analog transformed data in the first cycle and controlled by a second signal for outputting first analog data corresponding to the first analog transformed data in the second cycle; and a second analog sampling storage circuit coupled to the switch unit, controlled by the second signal for storing the second analog transformed data in the second cycle and controlled by the first signal for outputting second analog data corresponding to the second analog transformed data in a third cycle.

The embodiment according to the present invention also provides an organic light emitting diode display, comprising a plurality of pixels arranged in an array form; a scan driving circuit turning on a row of the pixels in sequence; a data driving circuit comprising data lines transmitting first digital data in a first cycle and second digital data in a second cycle, a D/A converter receiving the first digital data for transforming to corresponding first analog transformed data and receiving the second digital data for conversion to corresponding second analog transformed data, a switch unit coupled to the D/A converter and turned on by a sampling signal in the first cycle and the second cycle, a first analog sampling storage circuit coupled to the switch. unit, controlled by a first signal for storing the first analog transforming data in the first cycle and controlled by a second signal for outputting first analog data corresponding to the first analog transformed data in the second cycle, and a second analog sampling storage circuit coupled to the switch unit, controlled by the second signal for storing the second analog transformed data in the second cycle and controlled by the first signal for outputting second analog data corresponding to the second analog transformed data in a third cycle.

A detailed description is given in the following with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION

Figure 1A:
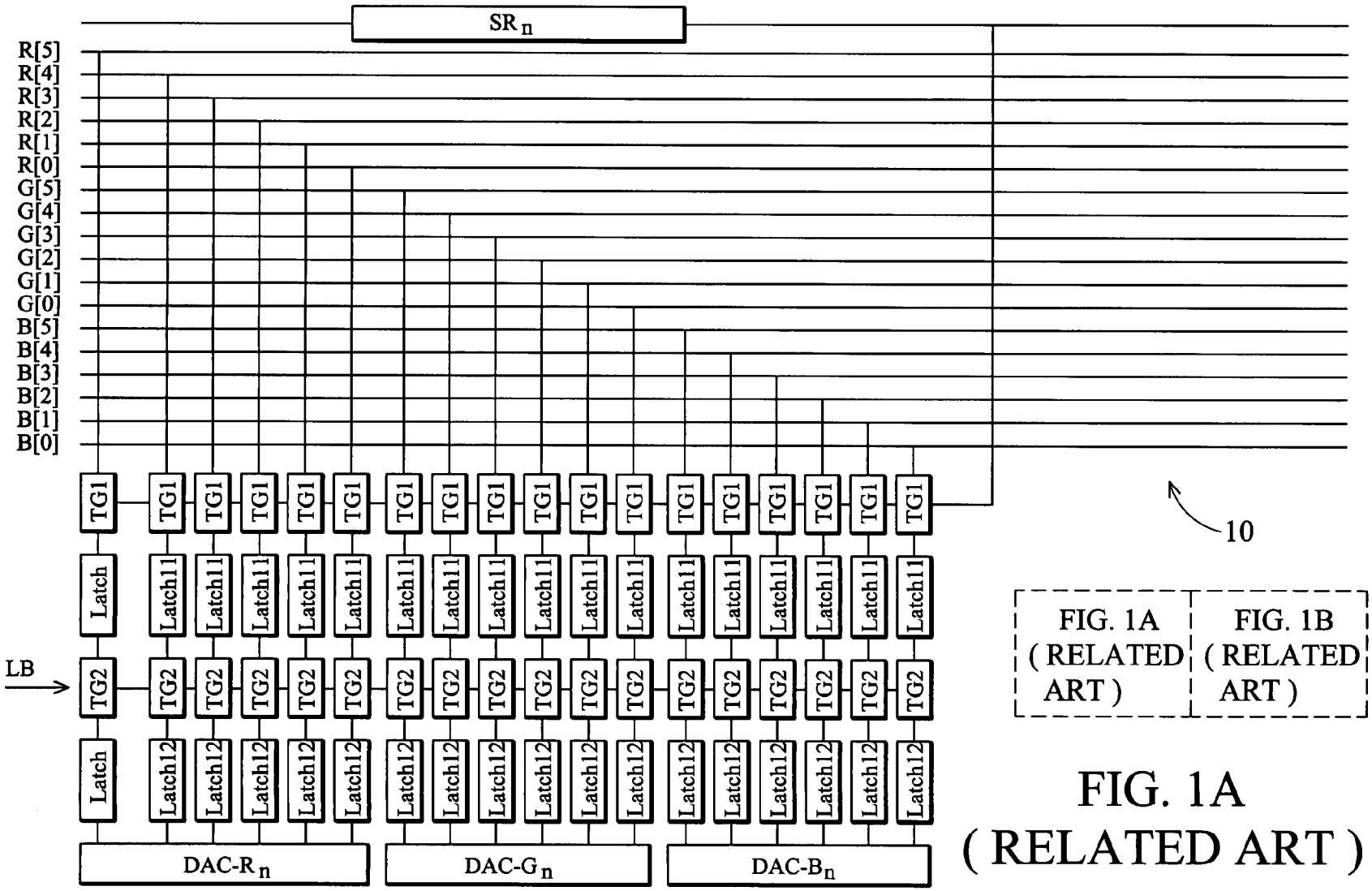
FIG. 1A (RELATED ART)
FIG. 1A and FIG. 1B show conventional digital data driving circuits.
Figure 1B:
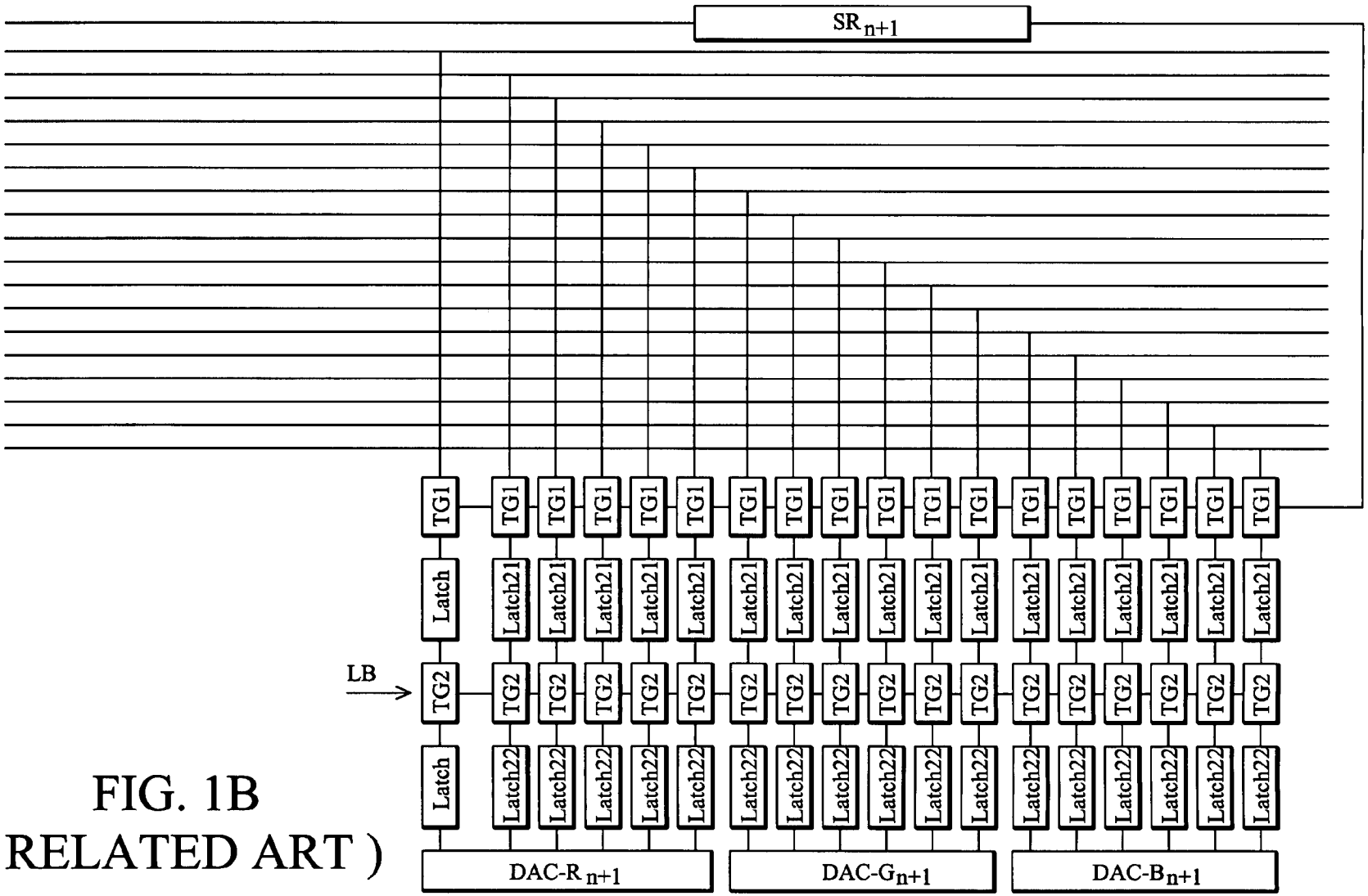
FIG. 1B ( RELATED ART )
Figure 2:
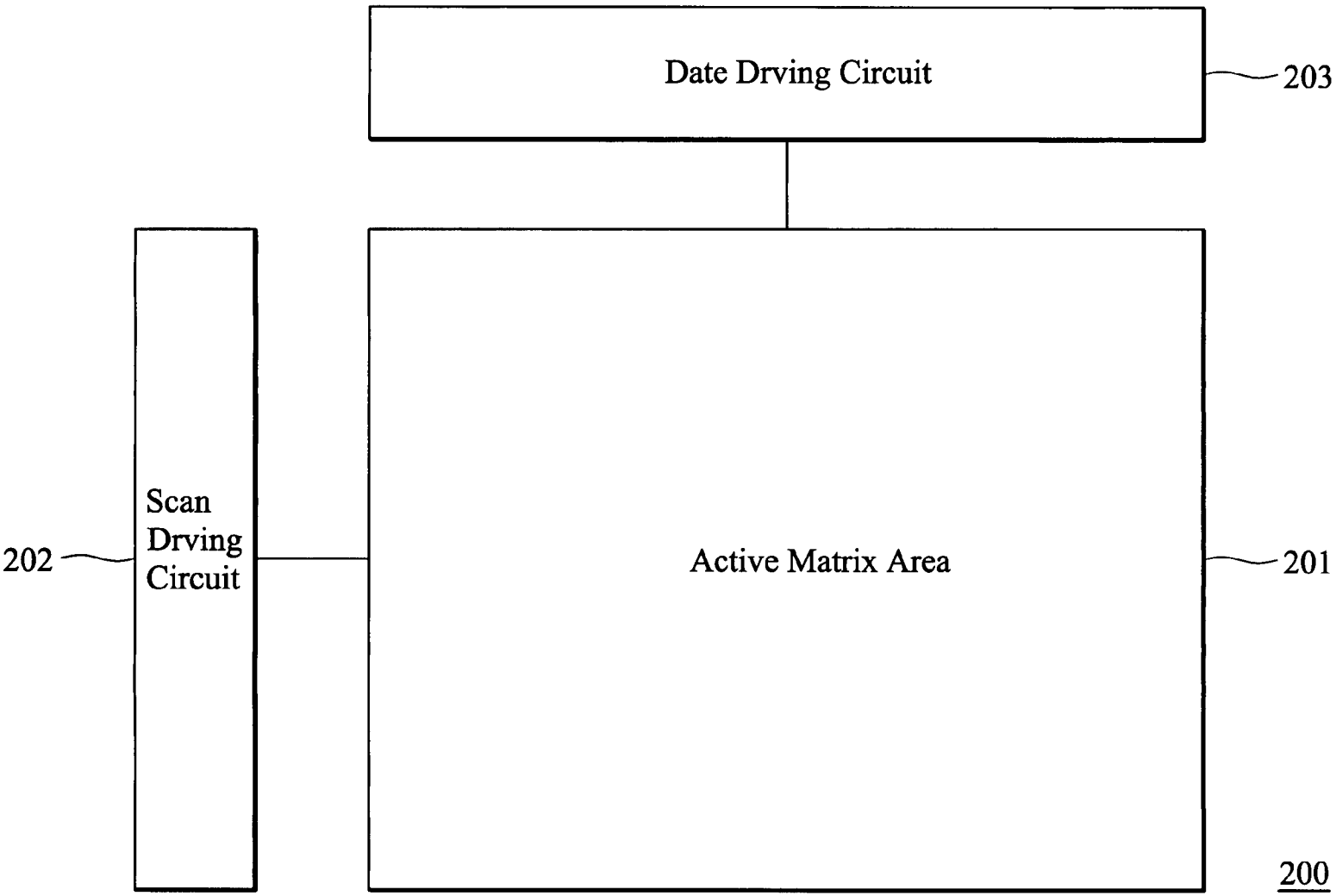
FIG. 2 illustrates an organic light emitting display.

FIG. 2 shows an organic light emitting diode display 200. As shown in FIG. 2, the organic light emitting diode display 200 comprises an active matrix array 201 substantially composed of a plurality of pixels, such as current driving pixels, a scan driving circuit 202 for turning on a row of pixels of the active matrix array 201 in sequence, and a data driving circuit 203 for outputting data to corresponding pixels.

Figure 3:
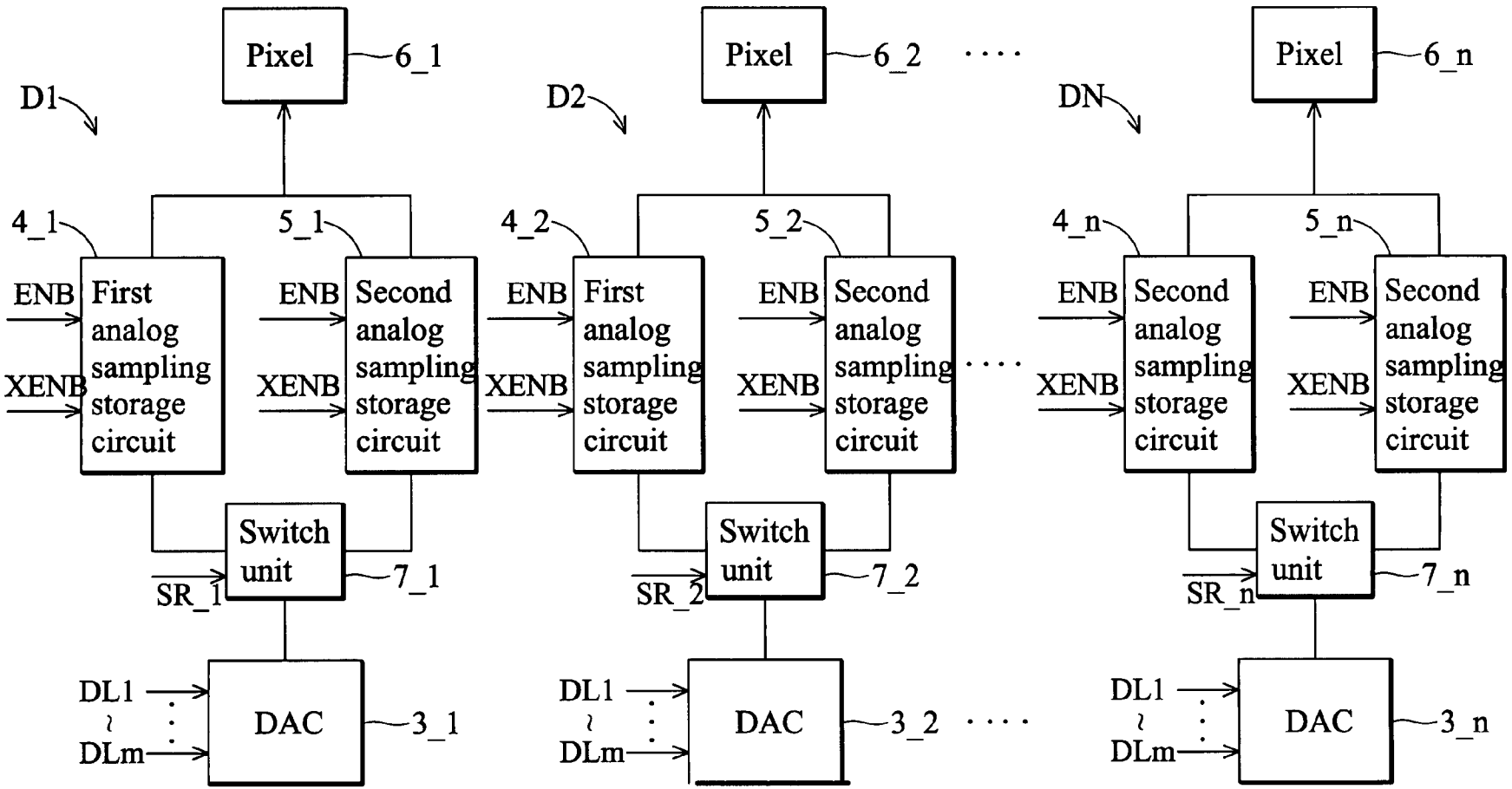
FIG. 3 is a block circuit diagram of a data driving circuit of an embodiment of the invention.

FIG. 3 shows a block diagram of the data driving circuit 203 in FIG. 2. The data driving circuit 203 comprises a plurality of data driving units D1~DN, each comprising D/A converter 3_1~3_*n*, a switch unit 7_1~7_*n*, a first analog sampling storage circuit 4_1~4_*n* and a second analog sampling storage circuit 5_1~5_*n*.

The D/A converters 3_1~$\mathbf{3}_{13}$ *n* are coupled to the data lines DL1~DLm for transforming digital data to corresponding analog transforming data, such as current data, in a cycle. The switch units 7_1~7_*n* are coupled to corresponding D/A converters 3_1~3_*n* to be turned on by corresponding sampling signals SR_1~SR_n in each cycle. The first analog sampling storage circuits 4_1~4_*n* are coupled to the switch units 7_1~7_*n* for storing the analog transformed data when a first signal ENB is asserted in a cycle, or outputting analog data which corresponds to the analog transformed data stored in the last cycle to the corresponding pixels 6_1~6_*n* when a second signal XENB is asserted. The second analog sampling storage circuits 5_1~5_*n* are coupled to the switch units 7_1~7_*n* for storing the analog transformed data when a second signal XENB is asserted in a cycle, or outputting analog data which corresponds to the analog transformed data stored in the last cycle to the corresponding pixels 6_1~6_*n* when the first signal ENB is asserted.

Figure 4:
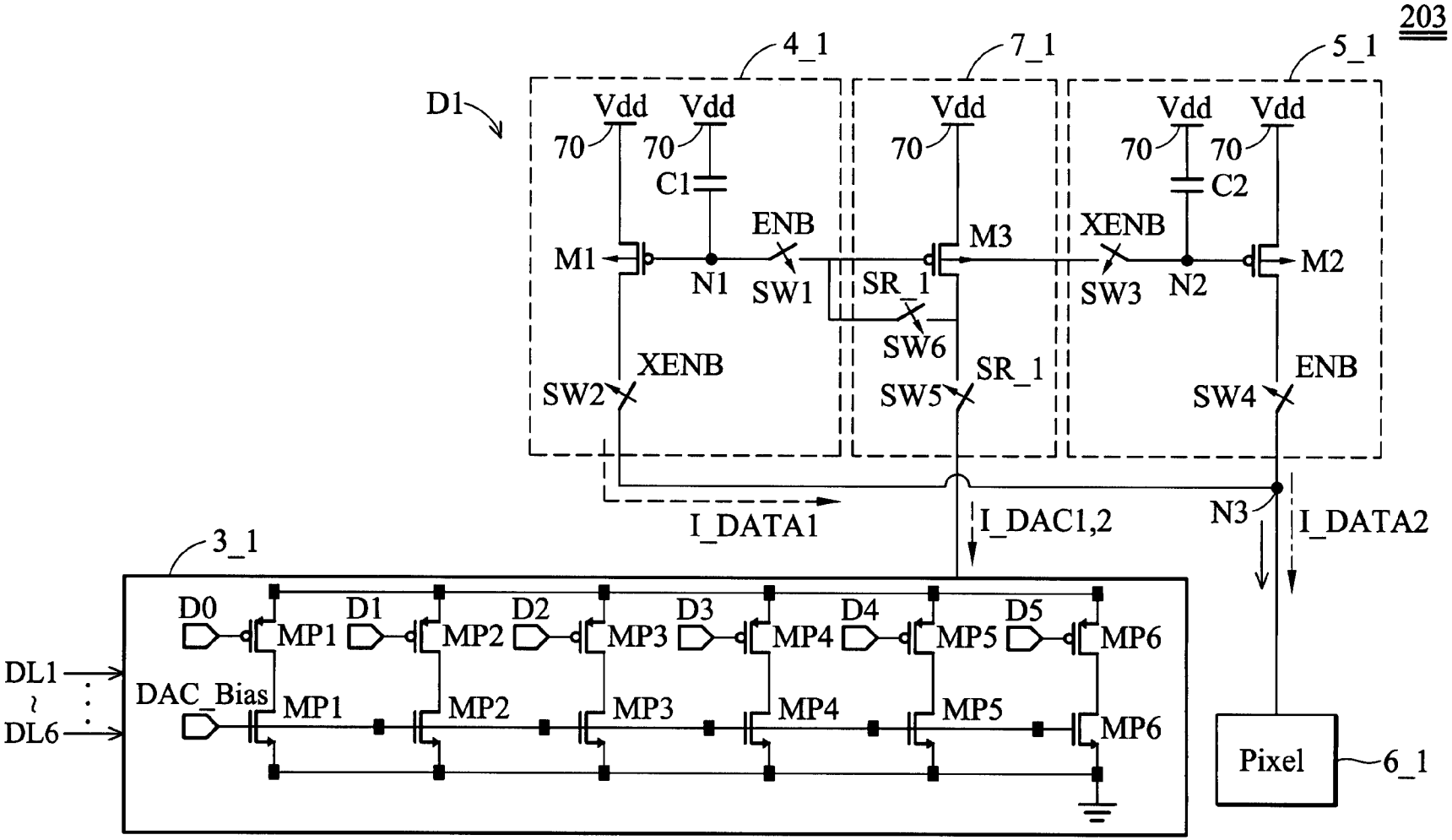
FIG. 4 is a detailed circuit of a data driving circuit of an embodiment of the invention shown in FIG. 3.

FIG. 4 illustrates a detailed circuit of the data driving circuit D1 shown in FIG. 3. 6 bit data D0~D5 is transmitted to a 6-bit D/A converter 3_1. In the example, the D/A converter 3_1 is a typical 6-bit D/A converter.

Switch unit 7_1 comprises a transistor M3 as a current source, such as a PMOS transistor. The source of the transistor M3 is coupled to a voltage source 70, such as high voltage source Vdd. A gate of the transistor M3 is coupled to one end of the switch SW6 (the sixth switch) A drain of the transistor M3 is coupled to the switch SW5 and the other end of the switch SW6. The switch SW5 and the switch SW6 are turned on when a sampling signal SR_1 is asserted.

The first analog sampling storage circuit 4_1 comprises a storage capacitor C1, a transistor M1, a switch SW1 and a switch SW2. The storage capacitor C1 is set between the voltage source 70 and a node N1. The transistor M1 has a source coupled to the voltage source 70 and a gate coupled to the node N1. The switch SW1 (the first switch) is set between the storage capacitor C1 and the gate of the transistor M3 to be turned on or turned off according to the first signal ENB. The switch SW2 (the second switch) is set between a drain of the transistor M1 and a node N3 to be turned on or turned off according to the second signal XENB.

The second analog sampling storage circuit 5_1 comprises a storage capacitor C2, a transistor M2, a switch SW3, and a switch SW4. The storage capacitor C2 is set between a voltage source 70 and a node N2. The transistor M2 has a source coupled to the voltage source 70, and a gate coupled to the node N2. A switch SW3 (the third switch) set between the storage capacitor C2 and the gate of the transistor M3 to be turned on or turned off according to the second signal XENB. Switch SW4 (the fourth switch) set between a drain of the transistor M2 and the node N3 to be turned on or turned off according to the first signal ENB.

Figure 5:
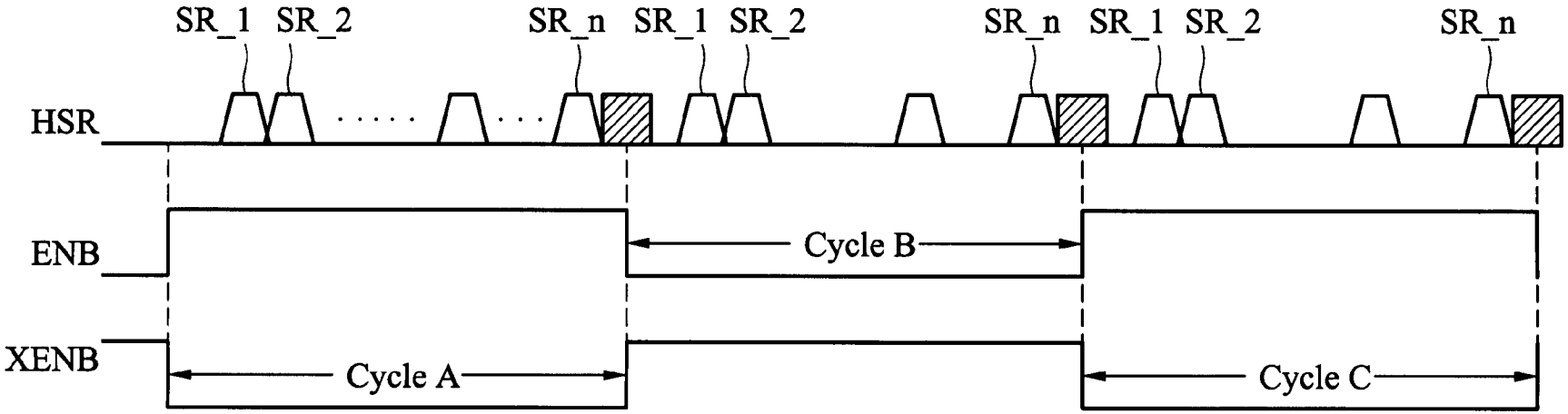
FIG. 5 is a timing diagram of the data driving circuit of an embodiment of the invention.

FIG. 5 is a timing diagram of the data driving circuit 203 in FIG. 4. First, in cycle A (the first cycle), digital data D0~D5 (first digital data) are transmitted to the D/A converter 3_1 through corresponding data lines DL1~DL6 for conversion to corresponding analog data I_DAC1 (first analog transforming data), such as current data. At the same time, a sampling signal SR_1 is applied to turn on switches SW5 and SW6. A first signal ENB is asserted to turn on switch SW1. Analog data I_DAC1 is written to the storage capacitor C1 through switch SW5, SW6 and Sw1.

In cycle B (the second cycle), the first signal ENB is desasserted to turn off switch SW1. The second signal XENB is asserted to turn on switches SW2. The analog data I_DAC1 of the storage capacitor C1 is sent to the gate of the transistor M1 for outputting a corresponding analog data I_DATA1 to pixel 6_1. At the same time, another digital data D0~D5 (second digital data) are written into D/A converter 3_1 for conversion to corresponding analog data I_DAC2 (second analog transforming data), such as current data. When the switch SW5 and switch SW6 are turned on by the sampling signal SR_1, and switch SW3 is turned on by the second signal XENB. The analog data I_DAC2 (second analog transforming data) is written to the storage capacitor C2 through switches SW5 SW6 and SW3.

In cycle C (the third cycle), the second signal XENB is desasserted to turn off switch SW3, and the first signal ENB is asserted to turn on switch SW4. The analog data I_DAC2 of the storage capacitor C2 is sent to the gate of the transistor M2 for outputting a corresponding analog data I_DATA2 to pixel 6_1.

Figure 6:
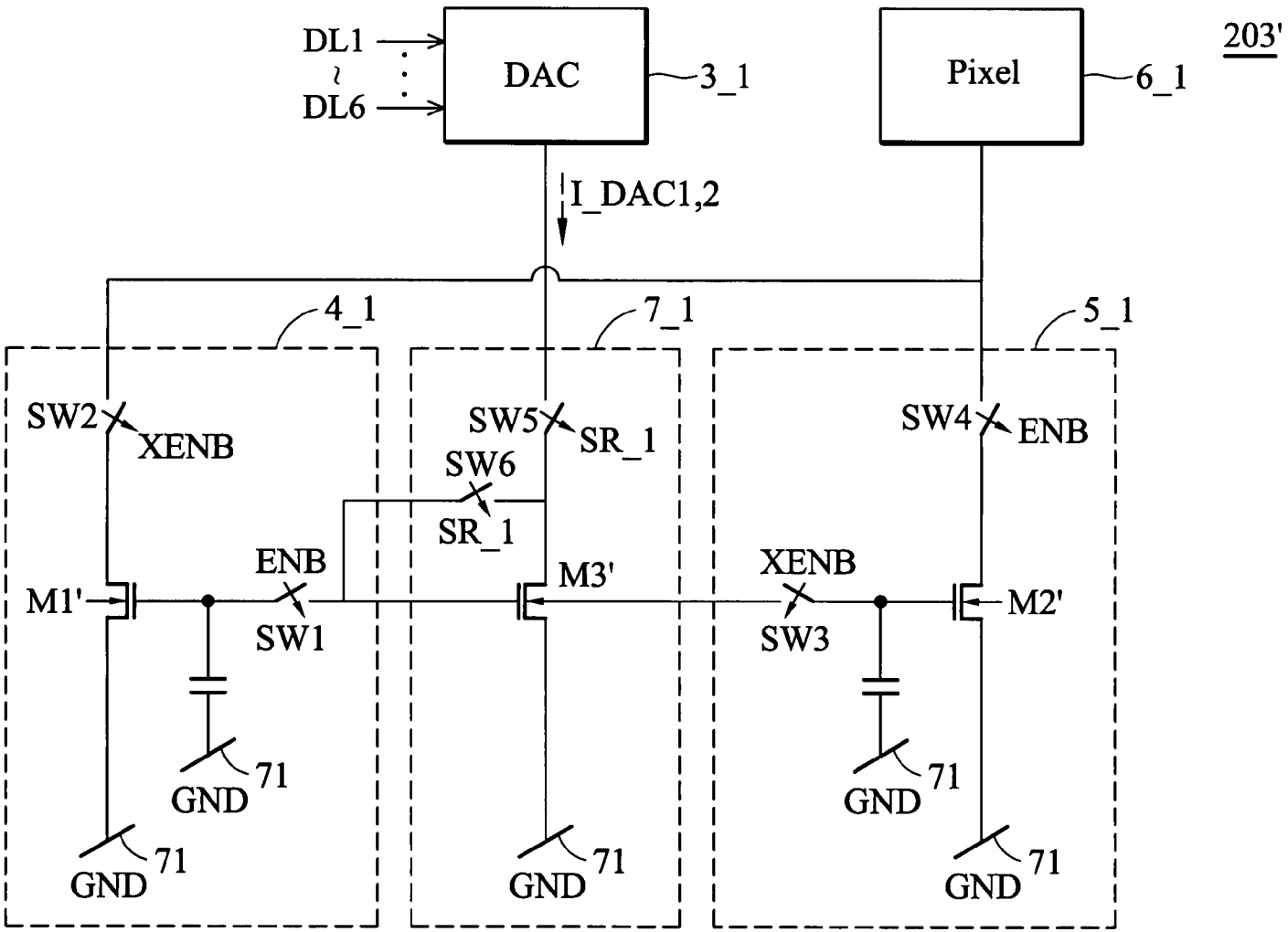
FIG. 6 is a circuit diagram of another embodiment of the invention.

FIG. 6 shows another embodiment of the data driving circuit 203' of the invention. The difference between the data driving circuit 203' and the data driving circuit 203 shown in FIG. 4 is that the transistors M1'~M3' are NMOS transistors, and the voltage source is a low voltage source Vss.

A driving method of embodiments of the invention is also disclosed. Through data lines, first and second digital data are received by a D/A converter in first and second cycle respectively, for conversion to first and second analog transformed data. The first analog transformed data is stored to a first analog sampling storage circuit in the first cycle. In the second cycle, first analog data corresponding to the first analog transformed data is output to drive to a pixel while the second analog transformed data is stored to a second analog sampling storage circuit. In a third cycle adjacent to the second cycle, second analog data corresponding to the second analog transformed data is output to drive to the pixel.

While the invention has been described by way of example and in terms of preferred embodiment, it is to be understood that the invention is not limited thereto. On the contrary, it is intended to cover various modifications and similar arrangements as would be apparent to those skilled in the art. Therefore, the scope of the appended claims should be accorded the broadest interpretation to encompass all such modifications and similar arrangements.

What is claimed is:

1. A data driving circuit comprising:

a D/A converter for receiving first digital data from data lines in a first cycle to convert to first analog transformed data, and receiving second digital data from the data lines in a second cycle to convert to second analog transformed data;

a switch unit coupled to the D/A converter;

a first analog sampling storage circuit, coupled to the switch unit and coupled to the D/A converter through the switch unit, for storing the first analog transformed data in the first cycle, and outputting first analog data corresponding to the first analog transformed data in the second cycle, wherein the first analog sampling storage circuit comprises:

a first storage capacitor coupled to a voltage source and a first node;

a first transistor coupled to the voltage source and a pixel, a gate of the first transistor being coupled to the first node;

a first switch coupled to the first storage capacitor and the switch unit; and a second switch coupled to the first transistor and the pixel; and a second analog sampling storage circuit, coupled to the switch unit and coupled to the D/A converter through the switch unit, for storing the second analog transformed data in the second cycle, and outputting second analog data corresponding to the second analog transformed data in a third cycle, wherein the second analog sampling storage circuit comprising:

a second storage capacitor coupled to the voltage source and a second node;

a second transistor coupled to the voltage source and the pixel, a gate of the second transistor being coupled to the second node;

a third switch coupled to the second storage capacitor and the switch unit; and a fourth switch coupled to the second transistor and the pixel;

wherein the switch unit comprises a third transistor, having a first end coupled to the voltage source, a second end coupled to the first switch and the third switch, and a third end coupled to the D/A converter through a fifth switch and coupled to the first switch and the third switch through a sixth switch.

2. The data driving circuit as claimed in claim 1, wherein the first through the sixth switches are transistors or transmission gates.

3. An organic light emitting diode display, comprising:

a plurality of pixels arranged in an array form;

a scan driving circuit for turning on a row of the pixels in sequence; and a data driving circuit comprising:

a D/A converter for receiving first digital data from data lines in a first cycle to convert to first analog transformed data, and receiving second digital data from the data lines in a second cycle to convert to second analog transformed data;

a switch unit coupled to the D/A converter;

a first analog sampling storage circuit, coupled to the switch unit, for storing the first analog transformed data in the first cycle, and outputting first analog data corresponding to the first analog transformed data to a corresponding pixel in the second cycle, wherein the first analog sampling storage circuit comprises:

a first storage capacitor coupled to a voltage source and a first node;

a first transistor coupled to the voltage source and the corresponding pixel, a gate of the first transistor being coupled to the first node;

a first switch coupled to the first storage capacitor and the switch unit; and a second switch coupled to the first transistor and the corresponding pixel; and a second analog sampling storage circuit, coupled to the switch unit, for storing the second analog transformed data in the second cycle, and outputting second analog data corresponding to the second analog transformed data to the corresponding pixel in a third cycle, wherein the second analog sampling storage circuit comprises:

a second storage capacitor coupled to the voltage source and a second node;

a second transistor coupled to the voltage source and the corresponding pixel, a gate of the second transistor being coupled to the second node;

a third switch coupled to the second storage capacitor and the switch unit; and a fourth switch coupled to the second transistor and the corresponding pixel;

wherein the switch unit comprises a third transistor having a first end coupled to the voltage source, a second end coupled to the first switch and the third switch, and a third end coupled to the D/A converter through a fifth switch and coupled to the first switch and the third switch through a sixth switch.

4. The organic light emitting diode display as claimed in claim 3, wherein the first through the sixth switches are transistors or transmission gates.

* * * * *